US005711332A

United States Patent [19]

Apple

[11] Patent Number: 5,711,332

[45] Date of Patent: Jan. 27, 1998

[54] STRUTLESS UMBRELLA

[75] Inventor: Phillip C. Apple, Mt. Pleasant Mills, Pa.

[73] Assignee: American Holtzkraft, Inc., Mt. Pleasant Mills, Pa.

[21] Appl. No.: 726,475

[22] Filed: Oct. 7, 1996

Related U.S. Application Data

[63] Continuation-in-part of Ser. No. 592,527, Jan. 26, 1996, abandoned.

[51] Int. Cl.[6] ..... A45B 25/16; E04H 15/00

[52] U.S. Cl. ..... 135/20.3; 135/98; 135/39; 135/21; 135/29

[58] Field of Search ..... 135/98, 20.3, 39, 135/21, 38, 22, 29, 30

[56] References Cited

U.S. PATENT DOCUMENTS

| | | | |
|---|---|---|---|
| 534,058 | 2/1895 | Ackerman et al. | 135/20.3 X |
| 2,044,805 | 6/1936 | Meyerkort . | |
| 2,479,250 | 8/1949 | Mote | 135/15.1 |
| 2,721,569 | 10/1955 | Militano | 135/20.3 |
| 2,906,277 | 9/1959 | Militano . | |
| 2,917,060 | 12/1959 | Militano . | |
| 3,150,671 | 9/1964 | Frey | 135/20.3 |
| 3,410,285 | 11/1968 | Small | 135/20.3 |
| 3,658,077 | 4/1972 | Sato . | |
| 3,680,571 | 8/1972 | Houston . | |
| 3,744,503 | 7/1973 | Wolff et al. | 135/20.3 |
| 4,011,881 | 3/1977 | Becher . | |
| 4,084,600 | 4/1978 | de Polo | 135/15.1 |
| 4,201,237 | 5/1980 | Watts et al. | 135/98 |
| 4,421,133 | 12/1983 | Huang . | |
| 4,424,824 | 1/1984 | Becher . | |
| 4,607,653 | 8/1986 | Hermanson . | |
| 4,637,415 | 1/1987 | Dalo et al. | 135/98 |
| 4,807,655 | 2/1989 | Robertson . | |
| 4,813,442 | 3/1989 | Haines | 135/98 |
| 4,823,821 | 4/1989 | Day . | |
| 4,936,332 | 6/1990 | Wu | 135/29 X |
| 4,941,494 | 7/1990 | Wu . | |
| 4,989,625 | 2/1991 | Wu . | |
| 5,058,613 | 10/1991 | Su et al. . | |
| 5,213,122 | 5/1993 | Grady, II | 135/20.3 |
| 5,247,955 | 9/1993 | Wu | 135/22 |
| 5,293,890 | 3/1994 | Park et al. | 135/98 |
| 5,318,067 | 6/1994 | Day . | |

*Primary Examiner*—Wynn E. Wood
*Attorney, Agent, or Firm*—Thomas Hooker, P.C.

[57] ABSTRACT

A strutless umbrella includes a central post, either an inner plunger or tube, a canopy assembly including ribs pivotally mounted on the upper end of the central post. Links connect the ribs to the inner plunger or tube. Movement of one of the ribs moves the plunger or tube which moves the remaining ribs. A latch pin holds the umbrella in the open position.

20 Claims, 8 Drawing Sheets

STRUTLESS UMBRELLA this application is a continuation-in-part of application Ser. No. 08/592,527, filed Jan. 26, 1996, now abandoned.

FIELD OF THE INVENTION

The invention relates to strutless umbrellas, particularly larger umbrellas suited for patio and recreational use.

DESCRIPTION OF THE PRIOR ART

The canopy of a conventional umbrella is supported by a number of ribs which are pivotally attached to the top of a central post. Struts are pivotally connected to the ribs a distance below the upper ends of the ribs and extend to a collar that encircles the post and is movable along the post. The umbrellas are opened by sliding the collar along the post. As the collar is slid along the post, the struts push against the ribs causing the ribs to pivot away from the post and lift the canopy.

The strut and collar assembly presents several disadvantages to the user. For large umbrellas, consumers tend to open the umbrella by lifting one of the ribs instead of sliding the collar along the central post. The rib pulls on the corresponding strut which pulls one side of the collar. The uneven force on the collar caused by lifting one rib tends to twist and bind the collar on the post. The opening force on the rib may damage the rib. The pivot connections at the ends of the struts wear with age. A pivot may break causing the strut to fall and leave the rib without support. The user's hands or fingers can be pinched between the collar and the central post as the umbrella is operated and the collar slides along the post.

In addition to the disadvantages to the user, collars and struts add to the manufacturing cost of the umbrella. The stitching used to attach the canopy to the ribs is made more complex and more expensive by requiring an opening in the material to allow the strut to connect to the rib away from the rib end.

SUMMARY OF THE INVENTION

The present invention is a strutless umbrella that avoids the disadvantages associated with the conventional collar and strut umbrellas. The ribs of the present umbrella are pivoted on the upper end of the central post. Unlike a conventional umbrella, however, the ribs are pivoted a short distance from the upper ends of the ribs. In a first embodiment, links connect the upper ends of ribs to a inner plunger which slides in the hollow center of the central post. In another embodiment, links connect the upper ends of ribs to a tube which slides on the outside of the central post.

To open the present umbrella, the user lifts upwardly on the lower end of one of the ribs. As the rib pivots about its pivot connection, it acts as a lever and transfers a downward force through the link to either the plunger or tube. The plunger or tube applies a downward force on the remaining links which pivot the remaining ribs to the open position. Once the ribs are pivoted to their open positions and the inner plunger or tube is at its lowest point, a latch pin is inserted to hold the plunger or tube in place on the post and hold the umbrella open.

The umbrella is closed by releasing the latch pin and rotating one of the ribs toward the post to its closed position. The weight of the canopy and ribs rotates the ribs down to the closed portion adjacent the post. During closing the plunger or tube is raised on the post and is under the collapsed canopy.

Flexible connecting links, such as steel cable, may by used to connect the ribs to the plunger or tube. These links do not transmit compressive forces. In umbrellas using flexible links, a spring or counter weight biases the inner plunger or tube down, toward the lower or open position. Releasing the latch pin and lifting one of the ribs allows the plunger or tube to travel under force of the spring or weight to the lower or open position. As the plunger or tube travels to the lower position, the plunger or tube places tension on the flexible connecting links which in turn pivot the remaining ribs to the open position where the plunger or tube is latched in place.

The strutless umbrella allows the user to open the umbrella by lifting one of ribs rather than by sliding a collar. A mechanical advantage is achieved by applying the opening rotational force at a larger distance from the pivotal axis of the ribs. This is particularly helpful in opening heavy patio umbrellas. Additionally, the user's hands and fingers are less likely to be pinched as they operate the umbrella. Manufacturing costs are reduced because the number of parts is reduced. Simpler stitching may be used to attach the canopy to the ribs because the umbrella does not use struts.

Other objects and features of the invention will become apparent as the description proceeds, especially when taken in conjunction with the accompanying drawings illustrating the invention, of which there are eight sheets and three embodiments.

DESCRIPTION OF THE PREFERRED EMBODIMENTS

Figure 1:
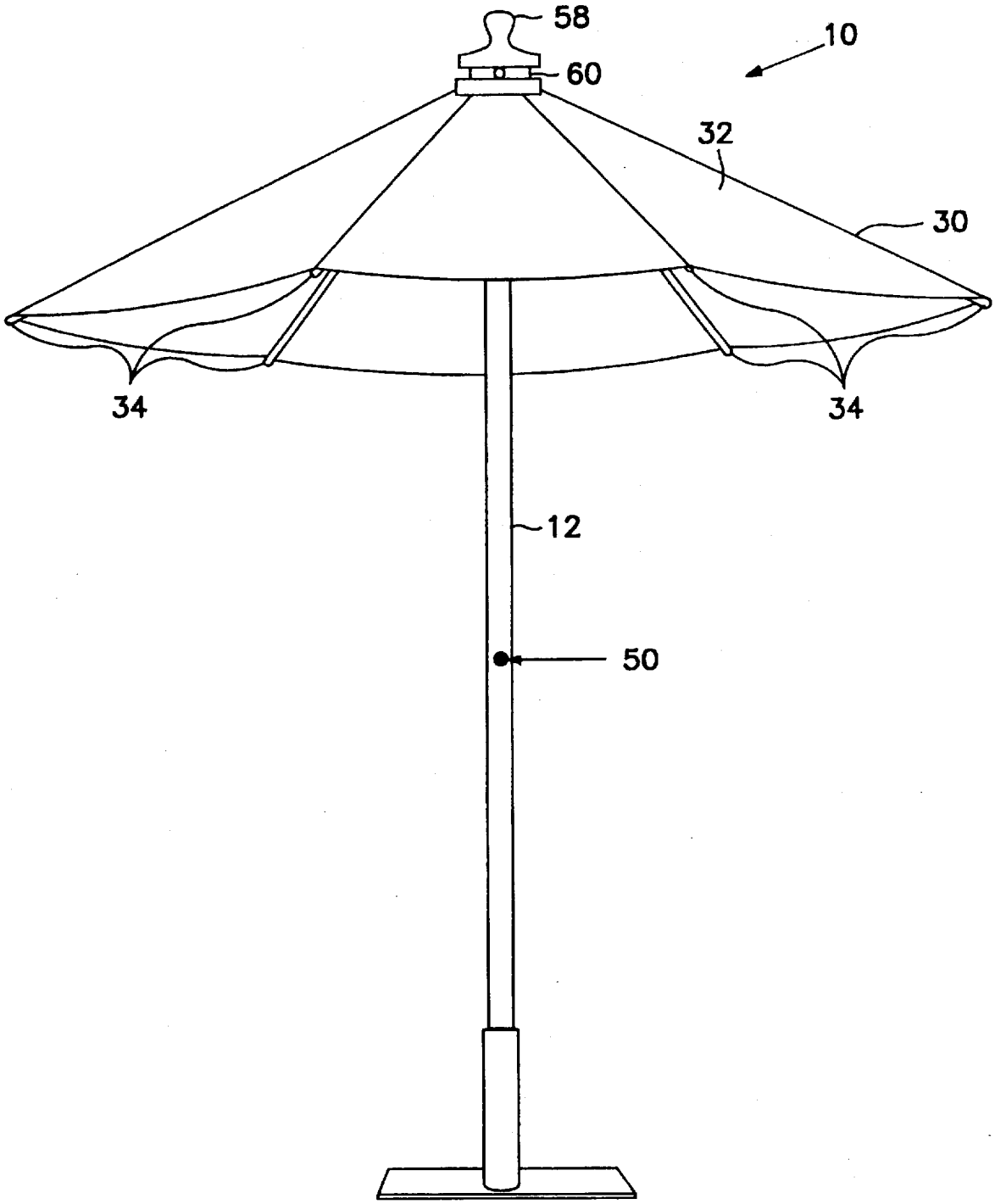
FIG. 1 is a perspective view of the umbrella with the plunger inside the center post in the open position.

Umbrella 10 has a hollow central post 12 with an inner plunger 14 that slides freely within post 12. A plurality of pairs of arms 13 extend radially from the upper end of the post. A plurality of ribs 34 are pivotally mounted on arms 13. Each rib 34 has an upper end 36, a lower portion 38, and a pivot point 40. The pivot point is located between a pair of arms 13. A hinge pin connects the pivot point 40 to the arms 13, pivotally mounting the rib on the central post 12. Rigid links 20, each having a rib end 22 and a plunger end 24, connect the ribs to the plunger. Clevises formed on the rib ends 22 of the links pivotally engage the upper ends 36 of ribs 34. Plunger ends 24 of links 20 are pivotally attached to the top of plunger 14. The umbrella has a canopy assembly 30 including a fabric canopy 32 mounted on the ribs 34. Canopy 32 is attached to the ribs to provide shade and protection when open.

Figure 2:
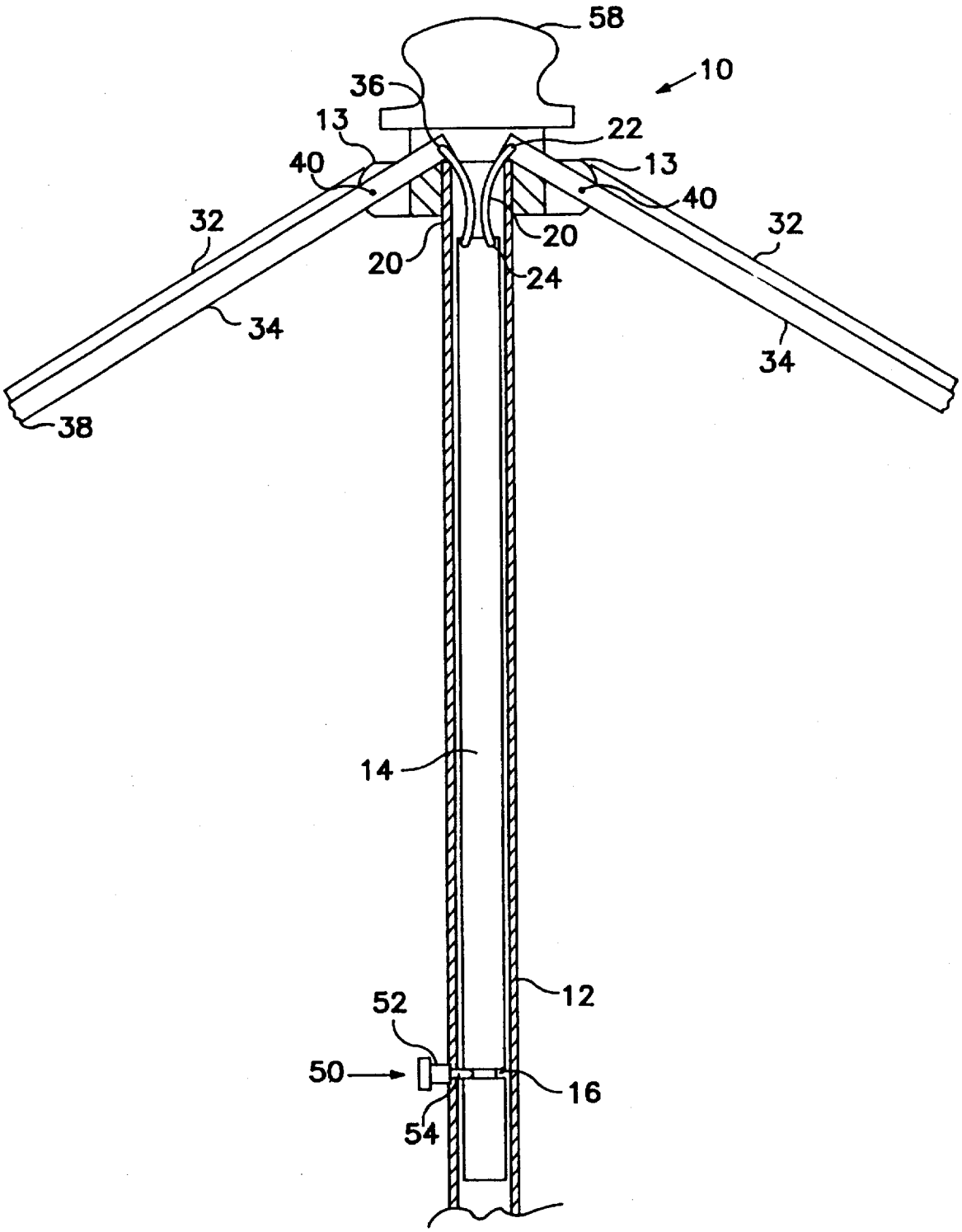
FIG. 2 shows a cross-section of the umbrella with the plunger in the open position.
Figure 3:
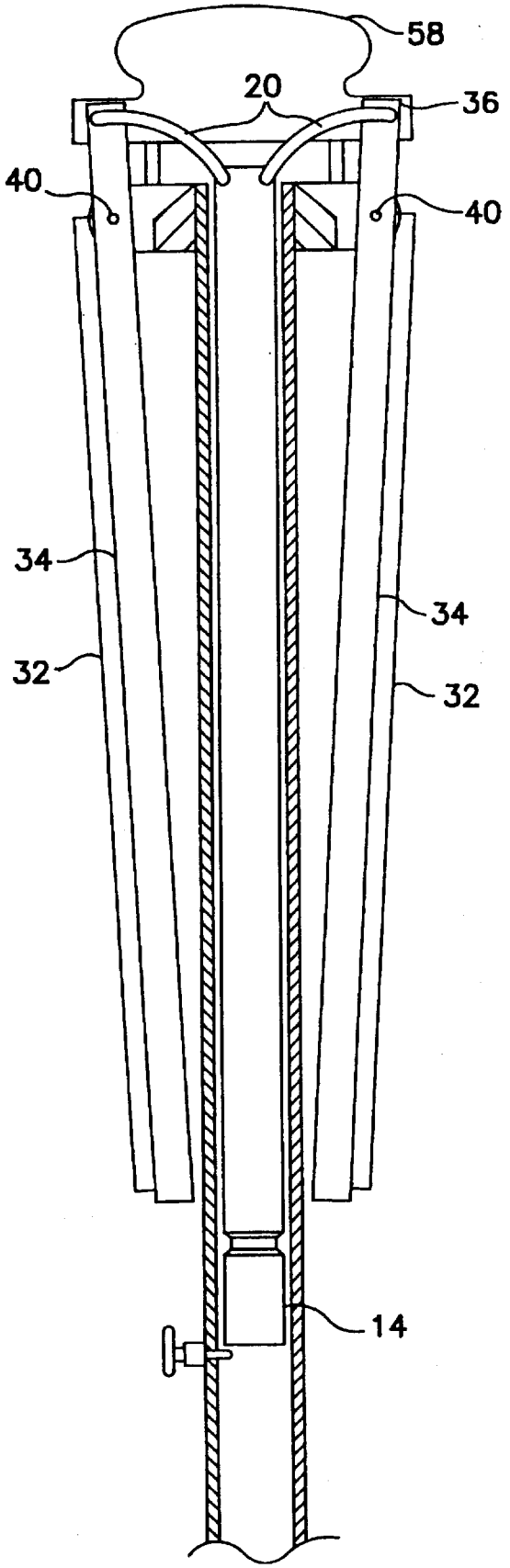
FIG. 3 shows a cross-section of the umbrella with the plunger in the closed position.
Figure 4:
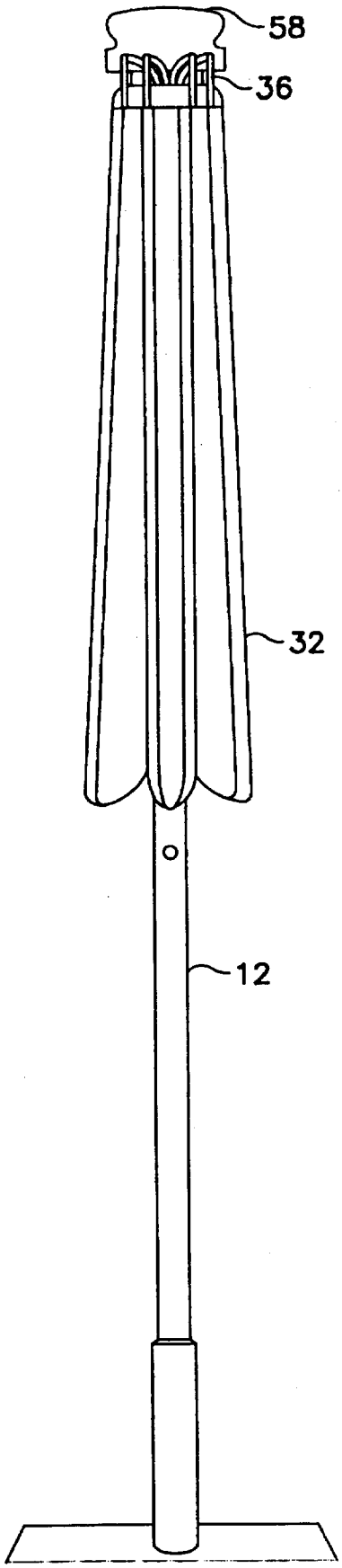
FIG. 4 shows a perspective view of the umbrella in the closed position.
Figure 5:
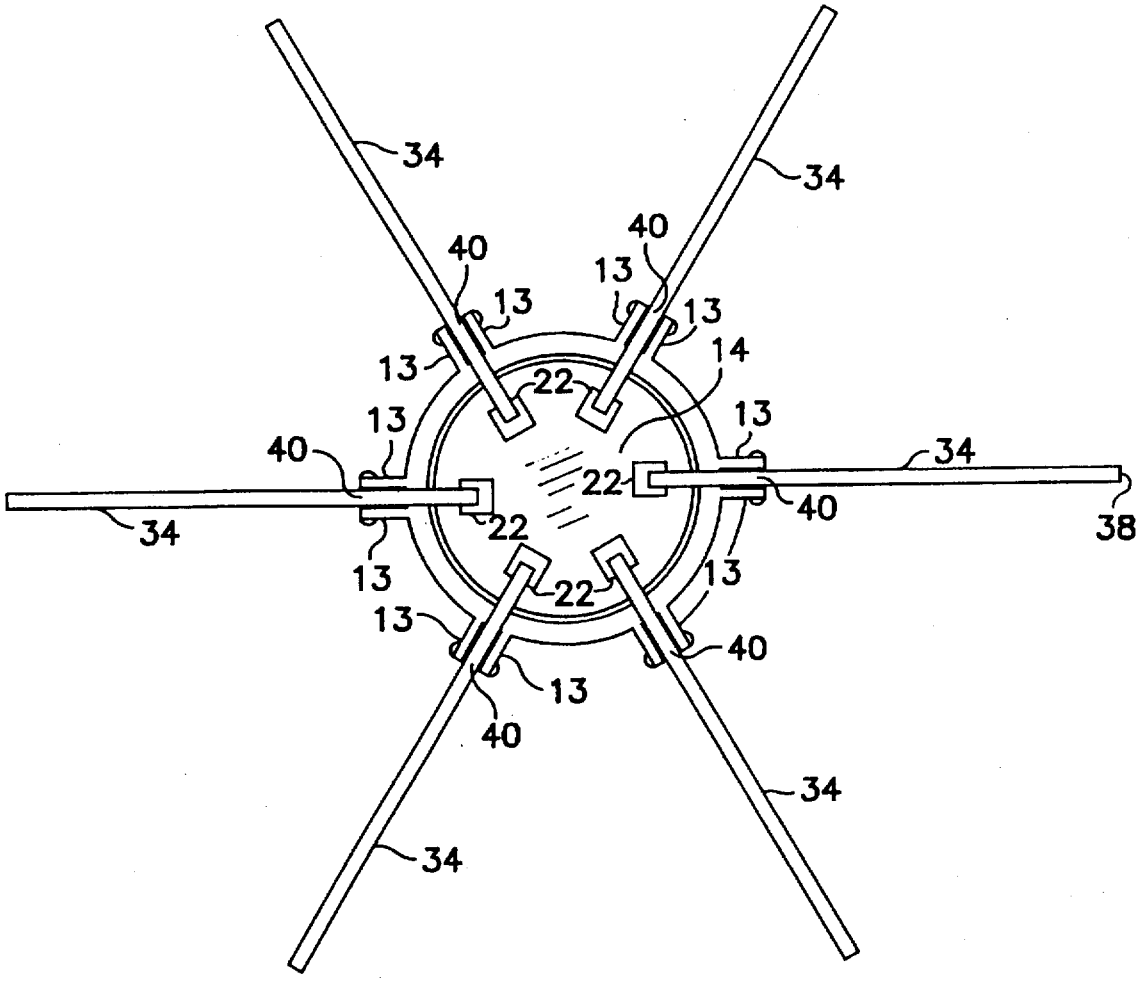
FIG. 5 shows a top view of the umbrella with the plunger in the open position with the canopy fabric and cupola removed.

Latch assembly 50 includes a pin 54 extending from outside the umbrella assembly 10 through latch collar 52 and the wall of central post 12 a short distance into the hollow center of post 12. A spring (not shown) biases the pin towards the hollow center of central post 12. When the umbrella is open and the plunger is in its lowered position as shown in FIG. 2, a groove 15 extending around the plunger 14 aligns with latch pin 54. The spring of latch assembly 50 biases pin 54 to engage groove 15. In this position, plunger 14 is fixed in the central post 12 and the umbrella is held open. When the umbrella is closed and the plunger is in its uppermost position as shown in FIG. 3, the bottom of the plunger 14 is above latch assembly 50. In this position, the plunger cannot move in the central post and the umbrella is held closed.

A cupola 58 is mounted above the top of post 12 on studs 60 extending from arms 13. The cupola protects the upper ends 36 of ribs 34 from damage while preventing precipitation form entering the top of the umbrella. The gap between cupola 58 and the top of central post 12 allows air to pass through the center providing ventilation under the umbrella.

Operation of the first preferred embodiment will now be described. From a latched closed position as shown in FIG. 3, an outward force applied to latch pin 54 releasing plunger 14 to freely travel in post 12. An upward opening force is then applied to an end of one of the ribs 34. As rib 34 pivots about its pivot point 40, the upper end 36 of the rib pivots down. The downward force of rib 34 is transmitted through a link 20 to plunger 14. Plunger 14 moves downward and pulls the other links 20 downward as it moves. The movement of links 20 pivots the other ribs 34 to the open position carrying the canopy to the open position. When the plunger reaches its lowest position, latch pin 34 engages grove 15 holding the umbrella open as shown in FIG. 2.

The umbrella is closed by applying an outward force on latch pin 54 releasing plunger 14 and pushing one of the ribs 34 to the closed position. As the rib pivots to the closed position, the upper end 36 of the rib moves upwardly lifting the corresponding link 20 and plunger 14. As the plunger travels, it moves the other links 20 and upper rib ends 36 upwardly pivoting the remaining ribs 34 down to the closed position. The weight of the canopy and ribs aids in closing the umbrella.

Figure 6:
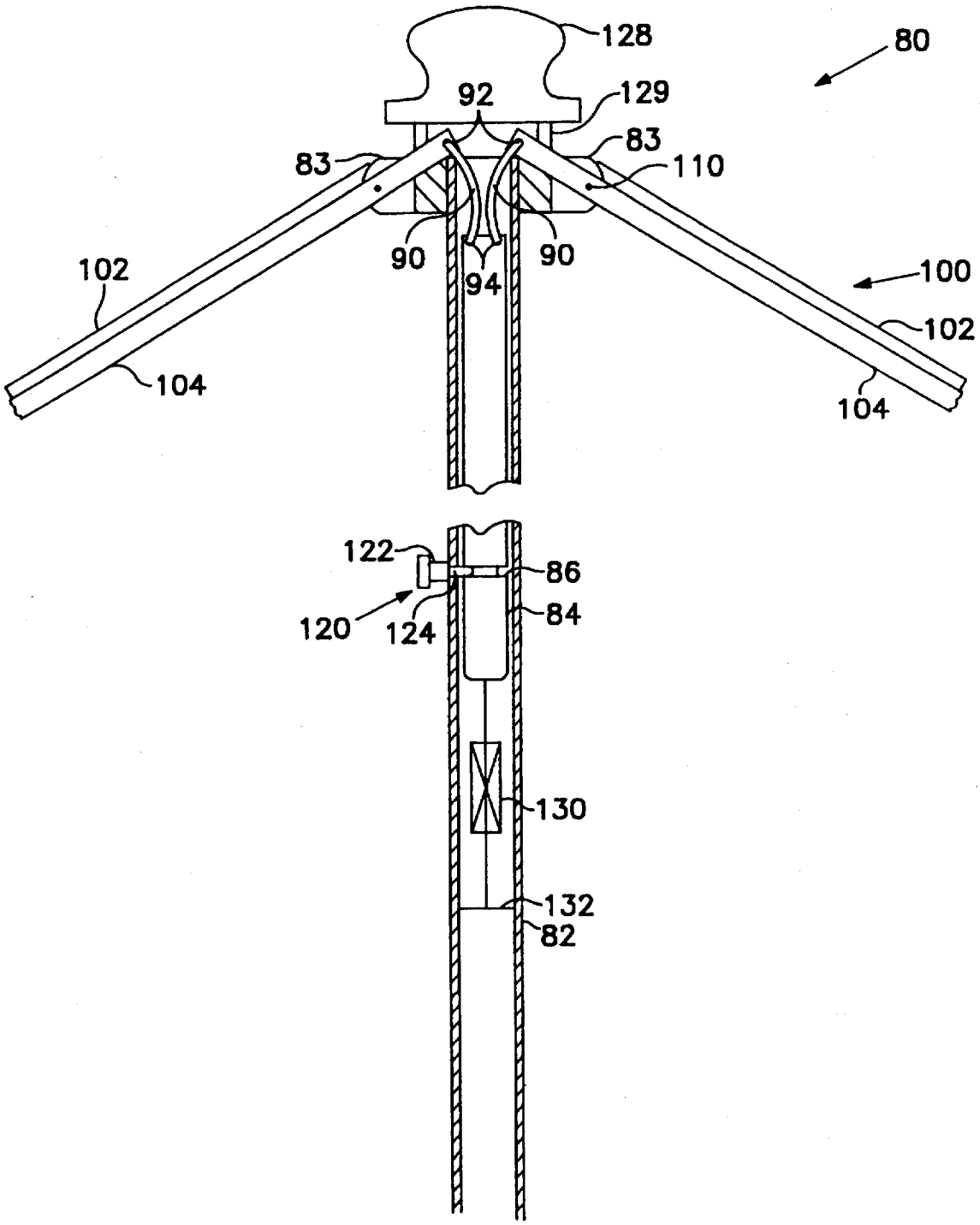
FIG. 6 shows a cross' section of the umbrella with the plunger and flexible links in the closed position.

A second preferred embodiment of the invention is shown in FIG. 6. Umbrella 80 includes a hollow central post 82 and an inner plunger 84 that freely slides within post 82. A plurality of pairs of arms 83 extend radially from the upper end of the post. A plurality of ribs 104 are pivotally mounted on the arms 83. Each rib 104 has an upper end 106, a lower end 108, and a pivot point 110. The pivot point 110 is located between a pair of arms 83. A hinge connects the pivot point 110 to the arms 83, pivotally mounting the rib on post 82. A series of non-rigid links 90, each having a rib end 92 and a plunger end 94 connect the upper ends 106 of ribs 104 to the plunger. Umbrella 80 has a canopy assembly 100 including a fabric canopy 102 and a plurality of ribs 104. Canopy 102 is attached to ribs 104 to provide shade and protection when open.

A spring 130 is attached to the bottom of plunger 84. The opposite end of the spring is attached to a anchor pin 132 mounted in the lower end of post 82. In this configuration, spring 130 biases the plunger to the lower or open position.

Latch assembly 120 includes a pin 124 extending from outside the umbrella assembly 90 through latch collar 122 and the wall of central post 82 a short distance into the hollow center of post 82. A spring (not shown) biases the pin towards the hollow center of central post 82. When the umbrella is open and the plunger is in its lowest position as shown in FIG. 6, a groove 85 aligns with latch pin 124. The spring of latch assembly 120 biases pin 124 to engage groove 85. In this position, plunger 84 is fixed in post 82 and the umbrella is held in the open. When the umbrella is closed and the plunger is in its uppermost position, the bottom of the plunger 85 is above latch assembly 120. In this position, the plunger cannot move in the post and the umbrella is held closed.

A cupola 128 is mounted above the top of post 82 on studs 129 extending from arms 83. The cupola protects the upper ends 106 of ribs 104 from damage while preventing precipitation form entering the top of the umbrella. The gap between cupola 128 and the top of central post 92 allows air to pass through the center providing ventilation under the umbrella.

Operation of the second preferred embodiment will now be described. An outward force is applied to latch pin 124 allowing plunger 84 to freely move within post 82. The bias applied by spring 130 causes plunger 84 to travel to its lowest position putting tension on the flexible connecting links 90. The tension on the links applies a downward force on the upper ends 106 of ribs 104 rotating the ribs about pivot point 110 to the open position. Once the umbrella is open, latch pin 124 engages groove 86 latching the umbrella in the open position and tension is maintained on the flexible links 90.

The umbrella is closed by releasing the latch and applying a closing force to the lower end 108 of one of the ribs 104. The rib rotates about pivot point 110 causing the upper end 106 of the rib to place tension on link 90. The tension and the weight of the ribs and canopy are sufficient to overcome the bias provided by spring 130 so that the plunger rises to the upper or closed position. As the plunger rises, the tension on links 90 is released and the ribs 104 pivot to the closed position. When the ribs reach the closed position, the plunger is in its uppermost position with its bottom located a short distance above the latch assembly. The spring of the latch assembly 120 forces the pin 124 into the hollow center of the central post 82 preventing the plunger from traveling to the lower or open position. If desired, a weight may be attached to plunger 84 instead of spring 130. The weight and spring both bias the plunger down to open the umbrella.

Figure 7:
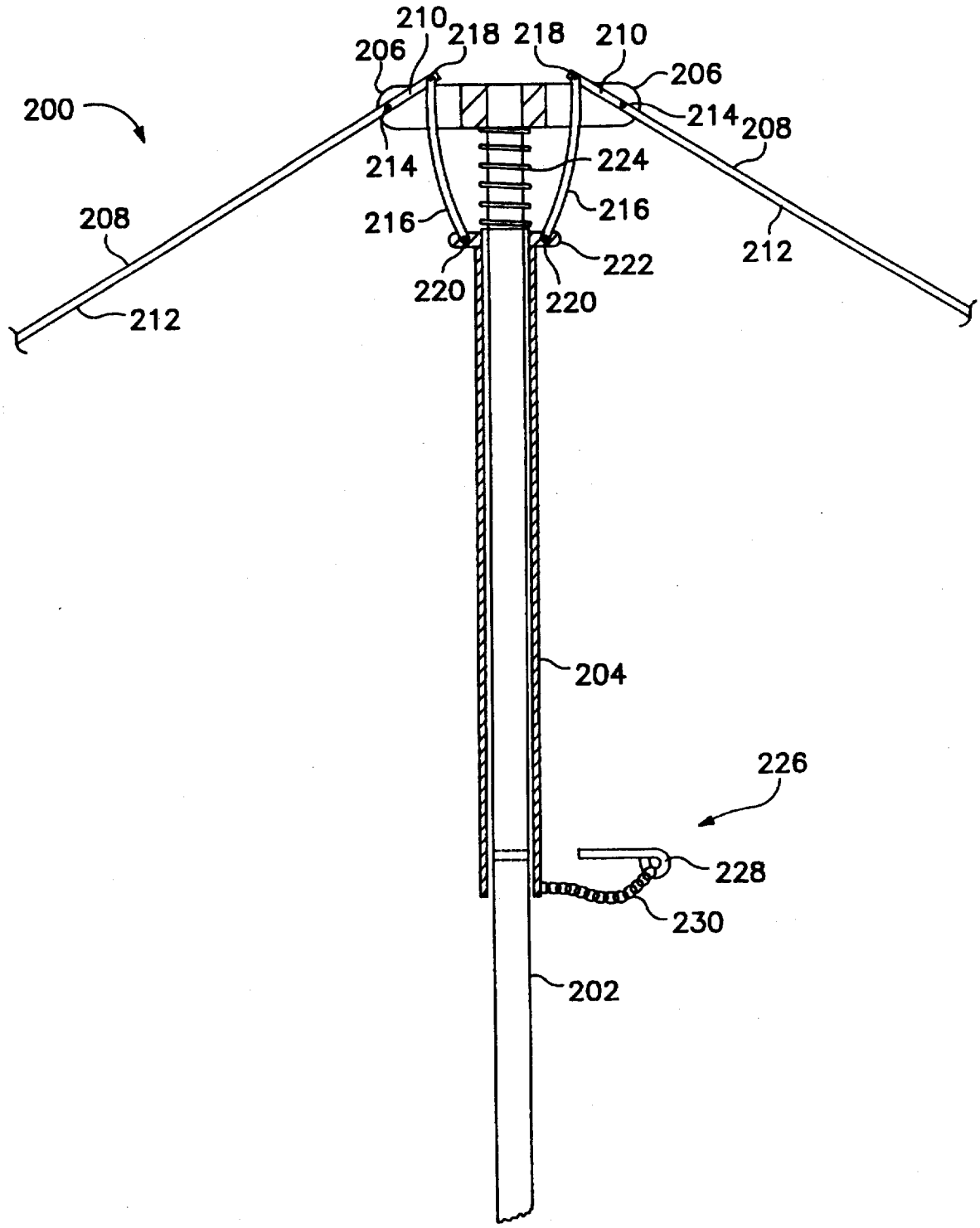
FIG. 7 is a view like FIG. 2 illustrating an open umbrella with the ribs connected to a tube surrounding the upper ends of the post by links.
Figure 8:
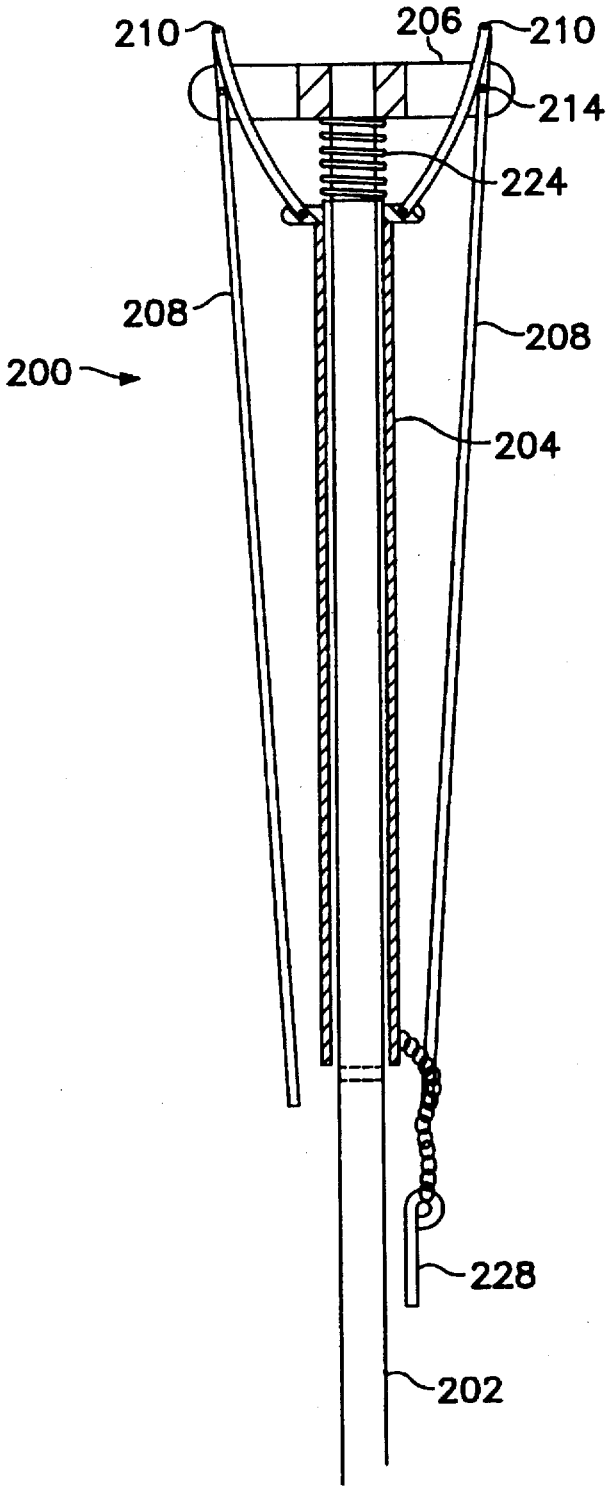
FIG. 8 is a view showing the umbrella of FIG. 7 closed.

A third preferred embodiment umbrella is shown in FIGS. 7–8. The canopy is not shown, it being understood that a canopy is attached to the umbrella ribs. Umbrella 200 has a central post 202 with a tube 204 that surrounds and slides freely along post 202. A plurality of pairs of mounting arms 206, like arms 13, extend radially from the upper end of the post. A plurality of ribs 208 are pivotally mounted on arms 206. Each rib 208 has an upper end 210, a lower portion 212, and a pivot point 214. The pivot point is located between a pair of arms 206. A hinge pin connects the pivot points 214 to the arms 206, pivotally mounting the ribs on the central post 202. Rigid links 216, each having a rib end 218 and a tube end 220, connect the ribs to the tube. Clevises formed on the rib ends 218 of the links pivotally engage the upper ends 210 of ribs 208. Tube ends 220 of links 216 are pivotally attached to member 222 on the top of tube 204. A canopy assembly (not illustrated) is mounted on the ribs 208. Compression spring 224 is confined on the upper end of post 220 between arms 206 and member 222. Spring 224 functions like spring 130.

Latch assembly 226 includes a pin 228 joined to the outside of tube 204 by chain 230. The pin 228 is inserted through openings in the walls of tube 204 and a bore in central post 202, to secure the umbrella 200 in the open position. When the umbrella is open, tube 204 is in its lowermost position as shown in FIG. 7.

With the umbrella closed and the tube in its uppermost position as shown in FIG. 8, the bottom of the tube 204 is above the bore in post 202 and is above the lower ends of the canopy and ribs. The umbrella is held closed by a tie surrounding the collapsed canopy and ribs.

Operation of the umbrella according to the third embodiment will now be described. From a closed position as shown in FIG. 8, an opening force is applied to the lower end of one of the ribs 208. As rib 208 pivots about its pivot point 214, the upper end 210 of the rib pivots down. The downward force of rib 208 is transmitted through a link 216 to tube 204. Tube 204 moves downward and pulls the other links 216 down with it. Spring 224 pushes the tube down to aid in opening the umbrella. The movement of links 216 pivots the other ribs 208 up to the open position carrying the canopy to the open position. When the tube reaches its lowest position, latch pin 228 can be inserted through the tube and post to hold the umbrella open as shown in FIG. 7.

The umbrella is closed by withdrawing the pin and pushing one of the ribs 208 down toward the closed position. As the rib pivots The umbrella is closed by withdrawing the pin and pushing one of the ribs 208 down toward the closed position. As the rib pivots to the closed position, the upper end 210 of the rib moves upwardly lifting the corresponding link 216 and tube 204. As the tube travels up, it moves the other links 216 and upper rib ends 210 up to pivot the remaining ribs 208 down to the closed position. Spring 224 is compressed. The weight of the umbrella canopy aids in closing the umbrella.

Umbrella 200 may be provided with non-rigid links, like links 90 of umbrella 80, if desired.

While I have illustrated and described three preferred embodiments of my invention, it is understood that this is capable of modification, and I therefore do not wish to be limited to the precise details set forth, but desire to avail myself of such changes and alterations as fall within the purview of the following claims.

What I claim as my invention is:

1. An umbrella including a central post having an upper end, a plurality of ribs surrounding the post, said ribs having upper ends, rib pivot connections located a distance from the upper ends of the ribs, said connections joining the ribs to the upper end of the post, a member movable along the post, a plurality of links, each link having a first link connection and a second link connection, said first-link connections joining the links to the upper ends of the ribs, said second link connections joining the links to the member, and a canopy on the ribs.

2. An umbrella as in claim 1 wherein the post is hollow and the plunger is located in the post.

3. An umbrella as claimed in claim 1 wherein the member surrounds the post.

4. An umbrella as in claim 3 wherein the link connections comprise pivot connections.

5. An umbrella as in claim 1 further comprising a member jointed to the plunger and biasing the plunger away from the top of the post and wherein said links are flexible.

6. An umbrella as in claim 1 further comprising an element joined to the member, said element biasing the member away from the top of the post.

7. An umbrella as in claim 5 wherein the member is a weight.

8. An umbrella as in claim 1 including a number of pairs of arms at the top of the post, each rib extending between a pair of arms with a pivot pin joining the rib to the pair of arms.

9. An umbrella as in claim 8 wherein the post is hollow and the plunger is located in the post.

10. An umbrella as in claim 1 including a plunger location member on the post.

11. An umbrella as in claim 10 wherein the plunger location member comprises a movable stop member, said plunger including a pair of stop surfaces spaced apart along the length of the plunger.

12. An umbrella as in claim 1 including a location element on the post.

13. An umbrella as in claim 12 wherein the location element comprises a movable stop, said stop including a pair of stop surfaces.

14. An umbrella including a central post having an upper end, a plurality of ribs surrounding the post, an umbrella canopy on the ribs, said ribs having upper ends, rib pivot connections located a distance from the upper ends of the ribs joining the ribs to the upper end of the post, a member movable along the outside of the post, and a plurality of links extending between the member and the upper ends of the ribs.

15. An umbrella as in claim 13 wherein the links are rigid.

16. An umbrella as in claim 13 wherein the links are flexible.

17. An umbrella as in claim 16 including a spring within the post connected between a bottom of the plunger and the post and biasing the plunger away from the top of the post.

18. An umbrella including a hollow central post having an upper end, a plurality of ribs surrounding the post, said ribs having upper ends, rib pivot connections located a distance from the upper ends of the ribs, said connections joining the ribs to the upper end of the post, a member mounted within the post for movement inside the post, a plurality of links extending between the member and the upper ends of the ribs, and a canopy on the ribs.

19. An umbrella as in claim 18 wherein the links are rigid.

20. An umbrella as in claim 18 including a spring biasing the member away from the upper end of the post.

* * * * *